United States Patent [19]

Ito et al.

[11] 4,004,714

[45] Jan. 25, 1977

[54] DRY DEVELOPING MECHANISM

[75] Inventors: Yoshio Ito; Tadayuki Kitajima, both of Yokohama; Yoshikuni Touyama, Tokyo, all of Japan

[73] Assignee: Canon Kabushiki Kaisha, Tokyo, Japan

[22] Filed: Feb. 13, 1975

[21] Appl. No.: 549,768

[30] Foreign Application Priority Data

Feb. 22, 1974 Japan ..... 49-21687

[52] U.S. Cl. ..... 222/41; 222/404

[51] Int. Cl.² ..... B67D 5/22

[58] Field of Search ..... 222/63, 56, 64, 66, 222/57, 23, 404, 41

[56] References Cited

UNITED STATES PATENTS

| | | | |
|---|---|---|---|
| 1,813,519 | 7/1931 | Varusky | 222/56 |
| 3,366,276 | 1/1968 | Fridley | 222/66 |
| 3,581,517 | 6/1971 | Pizzi | 222/56 |

*Primary Examiner*—Stanley H. Tollberg
*Assistant Examiner*—Hadd Lane
*Attorney, Agent, or Firm*—Fitzpatrick, Cella, Harper & Scinto

[57] ABSTRACT

A dry developing apparatus equipped with a developer amount detector, includes a container in which the developer is contained, a rotational member for agitating or carrying the developer, a support for supporting the rotational member in such a way that the rotational member, when rotated, is displaceable axially under the force of the load resistance produced by the presence of the developer, a holder for holding the rotational member so as to cause the member to return in the direction opposite to the direction of the displacement when the lead resistance is lessened with decrease of the developer, and a detector for detecting the difference in the amount of the axial displacement of the rotational member.

7 Claims, 4 Drawing Figures

FIG. 1
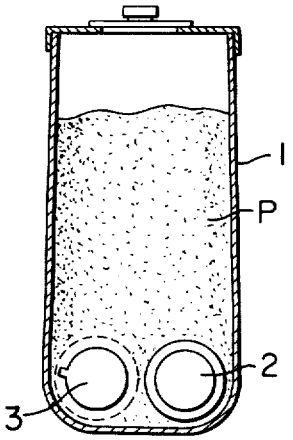
FIG. 2a
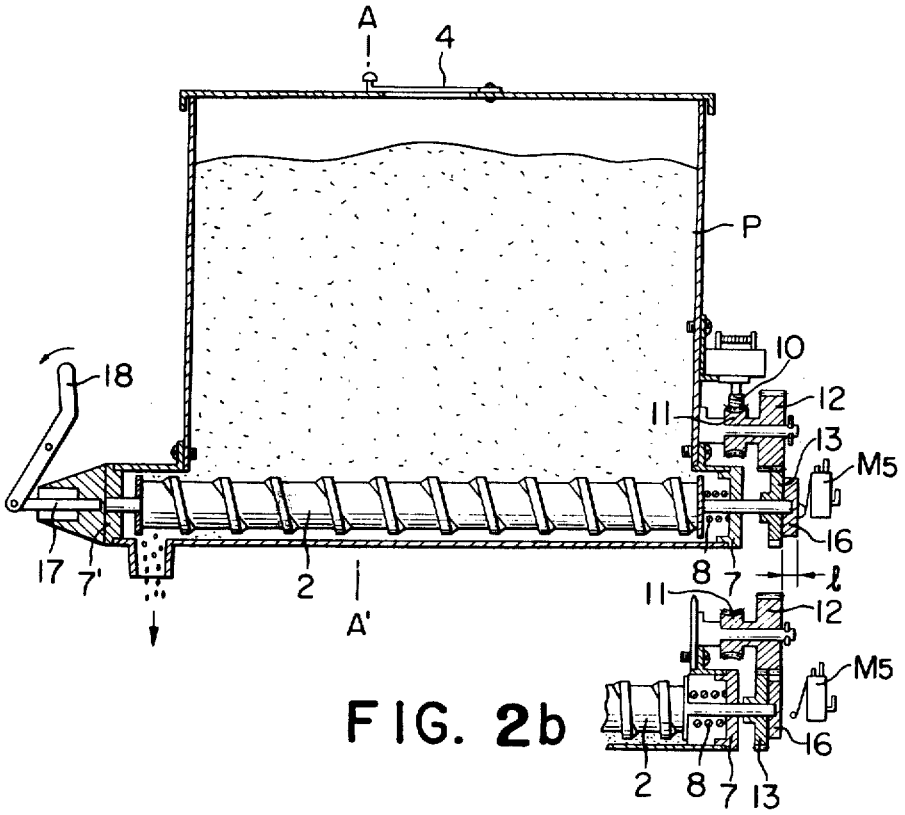
FIG. 2b

DRY DEVELOPING MECHANISM

BACKGROUND OF THE INVENTION

1. Field of the Invention

This invention relates to a dry developing apparatus designed for use in electrophotographic copying machines, and more particularly to an improved dry developing mechanism of the type recited, which is capable of accurately detecting the situation when the developer in the developer tank or in the developing unit in said mechanism has been decreased to a less than necessary amount.

2. Description of the Prior Art

Generally, in electrophotographic copying machines using a dry developing system, development is practiced by applying a powder developer after forming electrostatic latent images on a sensitive medium. Various dry developing systems have been devised, such as the magnetic brush system, the cascade system, the furbrush system or the powder cloud system, and in any of these systems, the powder developer is supplied or replenished from a hopper-like developer tank into the developing station as required. Also, the developer tanks used in these dry developing mechanisms may employ a wide variety of systems as occasion demands, such as for example a system in which the developer is supplied by dropping it from bottom opening of the developer tank with rotation of a roller having a rugged surface and provided in said opening, a transfer supply system in which the powder developer is transferred axially by rotation of a screw roller provided in the tank bottom, or a system in which the powder is dropped in accordance with reciprocation of a bottom member provided in the bottom opening of the tank.

It is important for consistently obtaining stabilized good-quality copied images to provide means for detecting the situation of shortage or insufficiency of developer in the developer tank and suspending the operation of the device which urges replenishment of the developer. The present invention is to provide a device which is capable of accurately and positively detecting such situation of shortage of developer whenever such situation is reached during operation of the copying machine.

In the electrophotographic copying machines of the liquid developing system, the residual quantity of the developing solution could be easily and accurately detected by using for instance a float means designed to determine the liquid level in the tank or by using a transparent liquid tank so as to determine the difference in the quantity of transmitted light. However, in the systems using powder developer, these methods are unable to correctly detect the residual amount of developer in the developer tank because the powder would adhere to the tank wall surface to intercept the transmitted light and also because the powder developer does not always decrease evenly in the tank. That is, there often occurs a phenomenon that the toner particles attached to the tank wall surface remain stuck thereon and are not used. There has heretofore been developed no satisfactory device which is inexpensive and capable of correctly and reliably detecting the residual quantity of powder developer in the dry type electrophotographic copying machines.

SUMMARY OF THE INVENTION

A primary object of the present invention, therefore, is to provide a dry developing mechanism equipped with means for accurately and positively detecting the amount of powder developer remaining in the powder developer tank.

Another object of the present invention is to provide an improved developing mechanism whereby the residual quantity of powder developer can be accurately detected by sensing a variation of moving load resistance of the developer carrying means which variation takes place depending on whether or not the developer is still present.

According to arrangements of the present invention, the device for delivering the powder developer from a hopper-like developer tank, such as a screw roller, rotary blades, a rugged roller and a moving block, is disposed in the bottom portion of the developer tank. When a large supply of powder developer remains in the tank, the delivery means is placed under the gravitational force of such developer and receives a considerable amount of moving load resistance or a reaction when delivering out the developer. Therefore, if said delivery device is movably supported by support members, it is urged by said reaction to move in the direction opposite to the direction in which the powder developer is supposed to be carried. In view of such fact, the present invention may include for instance a microswitch at such a position where it is either turned on or off according to the amount of said movement of the delivery means. That is, when the developer still exists in large amounts in the tank, the switch is turned on or off the force of said reaction, and when the developer decreases and the load resistance with respect to the delivery means is lessened, said delivery means is restored to its original position by a coil spring or other like means according to whether they are charged or not, and the microswitch is correspondingly turned on or off, with such behavior being converted into an electric signal to thereby detect the residual amount of developer.

BRIEF DESCRIPTION OF THE DRAWINGS

A dry developing mechanism according to the present invention is described in detail with reference to the accompanying drawings, in which:

FIGS. 1 to 3 show an embodiment of the dry developing mechanism according to the present invention, where FIG. 1 shows the internal construction of the mechanism, FIG. 2 is a longitudinal sectional view, and FIG. 3 is a perspective view of the device shown in FIG. 2.

DESCRIPTION OF THE PREFERRED EMBODIMENT

Figure 3:
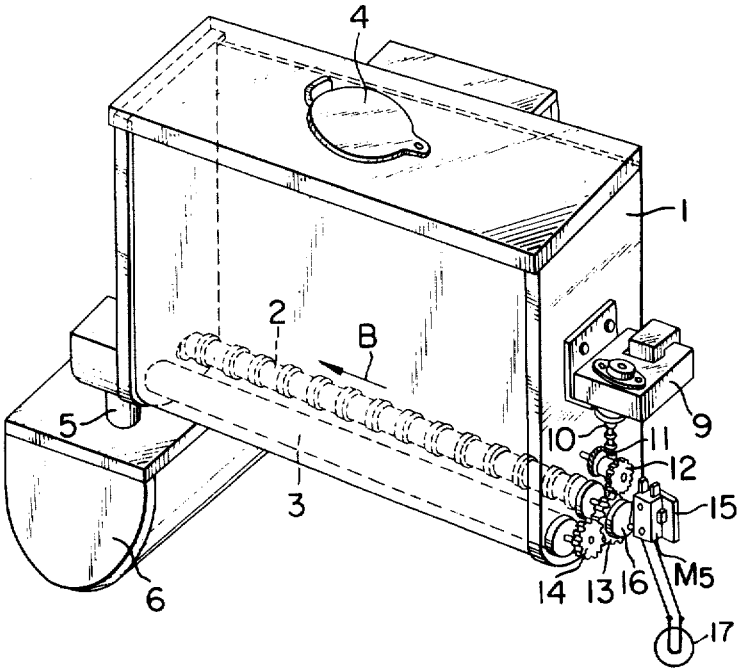

Referring first to FIG. 1, there is shown a developer tank, generally designated by numeral 1, which has provided therein a screw roller 2 journalled in the tank wall and a roller 3 having agitating blades, said both rollers being disposed substantially parallel and in closely adjacent to the side wall of said developer tank. Powder developer P is supplied into the tank 1 from its top opening which is normally closed by a cover 4, and the supplied developer P is agitated by the agitating roller 3, then carried in the direction of arrow B by the screw roller 2 and then discharged out from a developer feed port 5 into the developing unit 6 (see FIG. 3). The developing system employed in the developing unit may be any desired one of the aforementioned known systems, such as a cascade system, magnetic brush system, fur-brush system, powder cloud system, etc.

The present invention concerns a device for accurately and positively detecting the residual amount of powder developer P in the developer tank in the above-said type of developing mechanism, and the structural arrangements of the present device are now described with reference to FIGS. 2(*a*) and (*b*).

It will be seen that the screw roller 2 is rotatably journalled in the tank wall by means of bearings 7, 7'. At an end of said screw roller is provided a coil spring 8 which is interposed between said end of the screw roller and the bearing 7 so as to press said screw roller in the direction of arrow C as shown in FIG. 2(*b*). It will also be noted that a drive motor 9 for rotating said screw roller 2 and agitating roller 3 is secured to the developer tank wall 1 as shown in FIG. 3. When said motor is operated, its driving power is transmitted by a worm gear 10 mounted on the driving shaft of the motor to a worm wheel 11 and then to a spur gear 12 mounted coaxially with said worm wheel and thence further to another spur gear 13 mounted on the screw roller 2. The agitating roller is rotated as power is transmitted from said spur gear 13 from still another spur gear 14 mounted on the shaft of said roller. These spur gears have a sufficient width of engagement relative to each other to allow full transmission of power even when the spur gear 13 has reciprocated in its axial direction. A microswitch MS is provided at such a position on a support plate 15 secured to said tank wall 1 where said microswitch is turned on or off when said screw roller 2 reciprocates.

The present device having the above-described arrangements is now discussed from its operational aspect.

When the motor 9 is operated with the developer tank being filled with a required amount of developer, motor power is transmitted through the relaying gears to the screw roller 2 to let it rotate so as to carry the developer P in the direction of arrow B and supply it into the developing unit 6 from the feed port 5. During this operation, the screw roller 2 develops a load resistance such as frictional resistance due to the presence of the heavy-weight developer in the tank 1, and consequently, a thrust in the direction opposite to the developer carried direction is produced in the screw roller itself according to the principle of action and reaction. The torque produced on such occasion is determined by the size of the tank and the height above the lead screw of the screw roller, and it is possible to provides a force of about 20 gr to about 500 gr. As such thrust is produced, the coil spring 8 is compressed to urge the the rotating shaft portion of the screw roller to move while sliding on the bearing, and a planar rotational block 16 pushes the microswitch unit to convert mechanical displacement into an electric signal while continuing motor rotation. FIG. 2(*b*) shows the behaviour of the working parts when the developer in the tank has decreased to a less than required level. When the developer in the tank decreases, said load on the screw roller is rapidly lessened, so that the coil spring 8 is released from its compressed state and pushes the screw roller in the direction of C by its restoring force, and as a result, the rotating contact face 16 separates from the microswitch to shut down the motor 9 by an electric signal or to let an indication lamp 17 go on or off, thereby informing the operator of the necessity to replenish the developer into the container. When replenishment of developer into the tank is performed, the rotating contact face 16 keeps away from the microswitch, but when the developing operation is resumed, the start of such operation is indicated by a separate circuit regardless of turning-on or turning-off of the microswitch.

In the embodiment shown in FIGS. 1 to 3, the residual amount of developer is sensed by detecting the axial reciprocative movement of the screw roller by a microswitch, but the conception of the present invention is not limited to such embodiment but may be likewise embodied by other methods which utilize displacement of the developer delivery means that takes place according to whether the developer exists in the tank in a predetermined amount or not. For example, in the mechanism of FIG. 2, the spur gears 12 and 13 may be engaged with each other when the developer exists in a required amount and disengaged from each other to suspend operation of the developing mechanism when the developer has decreased less than the required amount (such engagement and disengagement being effected according to displacement of the screw roller). And such may be accomplished by reducing the width of engagement of the spur gear 12. The spur gears 12 and 13 are not engaged with each other when the developing operation is resumed after completion of replenishment of developer, but it is possible to have said gears engaged with each other before resumption of the developing operation by for instance pushing a pressure member 17 by a lever 18.

Detection of the residual amount of developer may be accomplished not by letting the developer delivering screw roller serve a double purpose but by separately providing a screw roller designed to serve solely for detection. Also, screw roller is not the only means usable for accomplishing the above-said detection; it is possible to use any other member which can be arranged to receive the load resistance provided by the presence of the developer and to make displacement upon receiving such resistance. Further, the residual amount detecting means may not necessarily be provided in the developer tank but may be provided in the developing mechanism to attain the same effect.

As described above in detail, the developing apparatus according to the present invention is capable of accurately and positively detecting the residual quantity of developer in the developer tank, and also the system can be simplified and reduced in size by making the developer delivering means serve concurrently for detection. It is also possible with use of the present apparatus to avoid defective copy resulting from shortage of developer, thus eliminating waste of copies.

We claim:

1. A dry developing apparatus equipped with means for detecting the amount of developer provided therein, comprising:

a container in which the developer is contained;

a rotational member for agitating or carrying the developer, said member being provided in said container;

means for supporting said rotational member such that said member, when rotated, is displaceable axially under the force of a load resistance produced by the presence of the developer;

discharge means including an opening provided in said container to release developer as it is carried by said rotational member, thereby limiting said load resistance, and to discharge said developer to a developing station;

means for urging said rotational member to make a returning movement in the direction opposite to the direction of said displacement when said load resistance is lessened with decrease of the developer; and means for detecting a difference in the amount of the axial displacement of said rotational member for providing an indication of a decrease in the amount of developer provided in the container.

2. A dry developing apparatus according to claim 1, wherein said rotational member is a screw roller.

3. A dry developing apparatus according to claim 1, wherein said urging means is a spring.

4. A dry developing apparatus according to claim 1, wherein said detecting means is a microswitch and operation of said rotational member is suspended by a signal from said microswitch.

5. A dry developing apparatus according to claim 1, wherein said detecting means is a microswitch and an indication lamp is switched on or off by a signal from said microswitch.

6. A dry developing apparatus equipped with means for detecting the amount of developer provided therein, comprising:

a container in which the developer is contained;

a rotational member provided in said container for agitating or carrying the developer;

a driving power source for driving said rotational member;

means for supporting said rotational member such that said member, when rotated, is displaceable axially thereof under the force of a load resistance produced by the presence of the developer;

means for urging said rotational member to make a returning movement in the direction opposite to the direction of said displacement when said load resistance is lessened with decrease of the developer;

a rotator for transmitting power from said power source; and a power receiving rotator provided coaxially with said rotational member and arranged to engage with said power transmitting rotator when said rotational member displaces and disengage from said power transmitting rotator when said rotational member makes a return movement in the opposite direction.

7. A dry developing apparatus according to claim 6, wherein said power transmitting rotator and power receiving rotator are gears.

* * * * *

UNITED STATES PATENT OFFICE

CERTIFICATE OF CORRECTION

Patent No. 4,004,714 Dated January 25, 1977

Inventor(s) YOSHIO ITO, ET AL.

It is certified that error appears in the above-identified patent and that said Letters Patent are hereby corrected as shown below:

In the Abstract, line 11, change "lead" to read --load--;

Column 1, line 22, change "furbrush" to read --fur-brush--;

Column 3, line 61, change "behaviour" to read --behavior--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*